US010344971B2

(12) United States Patent
Miller et al.

(10) Patent No.: US 10,344,971 B2
(45) Date of Patent: Jul. 9, 2019

(54) LOW NOX COMBUSTION

(71) Applicant: Fives North American Combustion, Inc., Cleveland, OH (US)

(72) Inventors: Todd A. Miller, Garfield Heights, OH (US); Thomas F. Robertson, Medina Township, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 357 days.

(21) Appl. No.: 15/180,226

(22) Filed: Jun. 13, 2016

(65) Prior Publication Data

US 2017/0356645 A1 Dec. 14, 2017

(51) Int. Cl.
*F23D 14/22* (2006.01)
*F23D 14/58* (2006.01)
*F23D 14/62* (2006.01)

(52) U.S. Cl.
CPC ..... *F23D 14/22* (2013.01); *F23D 14/58* (2013.01); *F23D 14/62* (2013.01); *F23D 2207/00* (2013.01); *F23D 2900/00008* (2013.01)

(58) Field of Classification Search
CPC ..... F23D 14/22; F23D 14/58
USPC ..... 431/6
See application file for complete search history.

(56) References Cited

U.S. PATENT DOCUMENTS 4,113,445 A * 9/1978 Gettert ..... C01B 3/363 252/373
4,629,413 A 12/1986 Michelson et al.
4,971,550 A * 11/1990 Schingnitz ..... C01B 3/363 431/145
5,829,369 A 11/1998 Sivy et al.
5,904,475 A * 5/1999 Ding ..... F23D 14/22 431/10
6,254,379 B1 7/2001 Bool, III et al.
6,773,256 B2 8/2004 Joshi et al.
6,824,383 B2 11/2004 Cain
2012/0129111 A1 5/2012 Robertson et al.
2014/0272735 A1 9/2014 Newby

OTHER PUBLICATIONS

Flame-Jet Gas Burners Parts list 4545-3, Fives North American Combustion, Inc. Jul. 2008.
4545 Flame-Jet Gas Burners Low NOx Bulletin 4545, Fives North American Combustion, Inc., Feb. 1997.

* cited by examiner

*Primary Examiner* — Avinash A Savani
(74) *Attorney, Agent, or Firm* — Benesch, Friedlander, Coplan & Aronoff LLP

(57) ABSTRACT

Air and fuel are directed from a burner outlet into a furnace process chamber in streams concentric on an axis, including an annular peripheral stream that includes fuel gas and adjoins products of combustion in the process chamber.

9 Claims, 5 Drawing Sheets

LOW NOX COMBUSTION

TECHNICAL FIELD

This technology includes an apparatus and method for suppressing the production of NOx in a furnace process chamber.

BACKGROUND

As described in U.S. Patent Publication No. 2014/0272735, a burner/control concept uses a conventional high velocity nozzle mix burner combined with a combustion mode transition from tile-stable to furnace-stable combustion when the furnace reaches or exceeds an auto-ignition temperature of the fuel, which is typically 1400 F. The furnace-stable combustion, which may be referred to as a diffuse mode of combustion (DMC), may produce less NOx than the tile-stable mode.

SUMMARY OF THE INVENTION

A method provides combustion products in a furnace process chamber, and directs combustion air and fuel gas from a burner outlet into the process chamber in streams concentric on an axis. The streams include an annular peripheral stream that includes fuel gas. The annular peripheral stream adjoins the products of combustion within the process chamber.

In a particular implementation, the method causes combustion air and fuel gas to ignite and combust in a diffuse mode in a furnace process chamber containing products of combustion having a temperature at or above an auto-ignition temperature of the fuel gas. The combustion air and fuel gas are directed from a burner tile outlet into the process chamber in unignited streams concentric on an axis. The unignited streams include an annular peripheral stream that includes fuel gas and adjoins the products of combustion in the process chamber.

In an apparatus for performing the method, a burner body structure defines a combustion air inlet and a fuel gas inlet. A first burner nozzle structure is configured to receive fuel gas from the fuel gas inlet, and to receive combustion air from the combustion air inlet. The first burner nozzle structure has a first outlet port centered on an axis. A second burner nozzle structure is configured to receive combustion air from the combustion air inlet. The second burner nozzle structure has a second outlet port centered on the axis of the first outlet port, and extends axially within the first nozzle structure to define an annular gas flow passage radially between the first and second burner nozzle structures. The apparatus further includes an igniter that is operative to ignite a combustible mixture of fuel gas and combustion air within the annular gas flow passage.

In a particular embodiment, the apparatus includes a burner body structure defining a combustion air inlet and a fuel gas inlet. A first refractory tile structure is configured to receive fuel gas from the fuel gas inlet, and has a first outlet port centered on an axis. A second refractory tile structure is configured to receive combustion air from the combustion air inlet. The second refractory tile structure is located within the first refractory tile structure, and has a second outlet port centered on the axis of the first outlet port.

DETAILED DESCRIPTION

Figure 1:
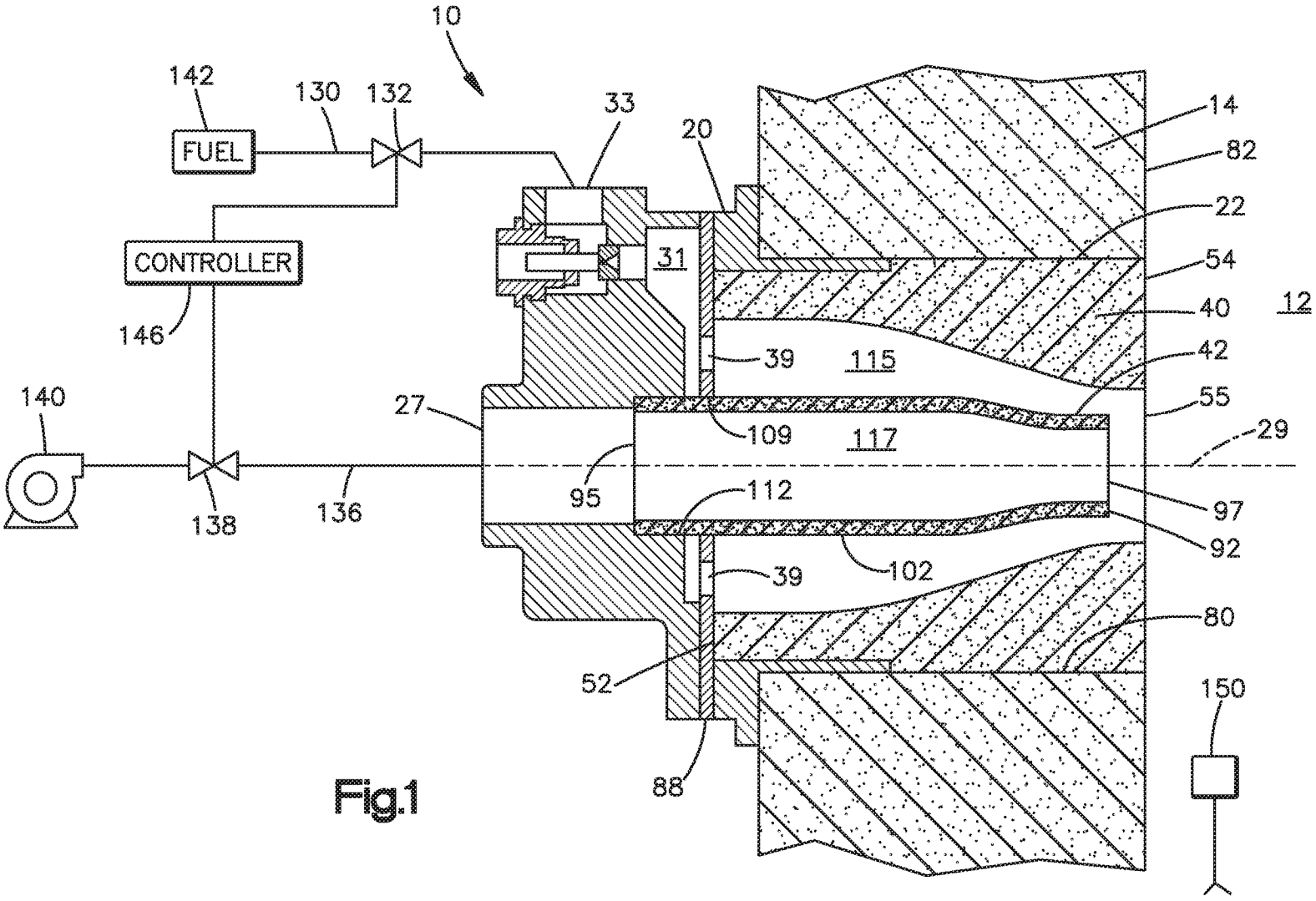
FIG. 1 is a schematic view of parts of a furnace including a burner that fires into a process chamber.

The apparatus shown schematically in the drawings has parts that are examples of the elements recited in the apparatus claims, and can be operated in steps that are examples of the steps recited in the method claims. These examples are described here to provide enablement and best mode without imposing limitations that are not recited in the claims.

As shown schematically in FIG. 1, an apparatus includes a burner 10 that is part of an industrial furnace having a process chamber 12. The burner 10 is mounted on a furnace wall 14 adjoining the process chamber 12, and operates to discharge reactants into the process chamber 12. The reactants discharged from the burner 10 provide products of combustion for a heating process to be performed on a load (not shown) in the chamber 12.

The burner 10 in the illustrated example has a burner body portion 20 and a burner nozzle portion 22. The body portion 20, which is preferably formed of metal, defines a combustion air inlet 27 with a central axis 29. The body portion 20 further defines a fuel gas plenum 31 with a fuel gas inlet 33. In this example, the fuel gas plenum 31 has multiple outlets 39 in a circular array centered on the axis 29.

The nozzle portion 22 of the burner 10 includes first and second burner nozzle structures 40 and 42. In the illustrated example, each of the two nozzle structures 40 and 42 is a tile structure formed as a unitary body of refractory material separate from the other.

Figure 2:
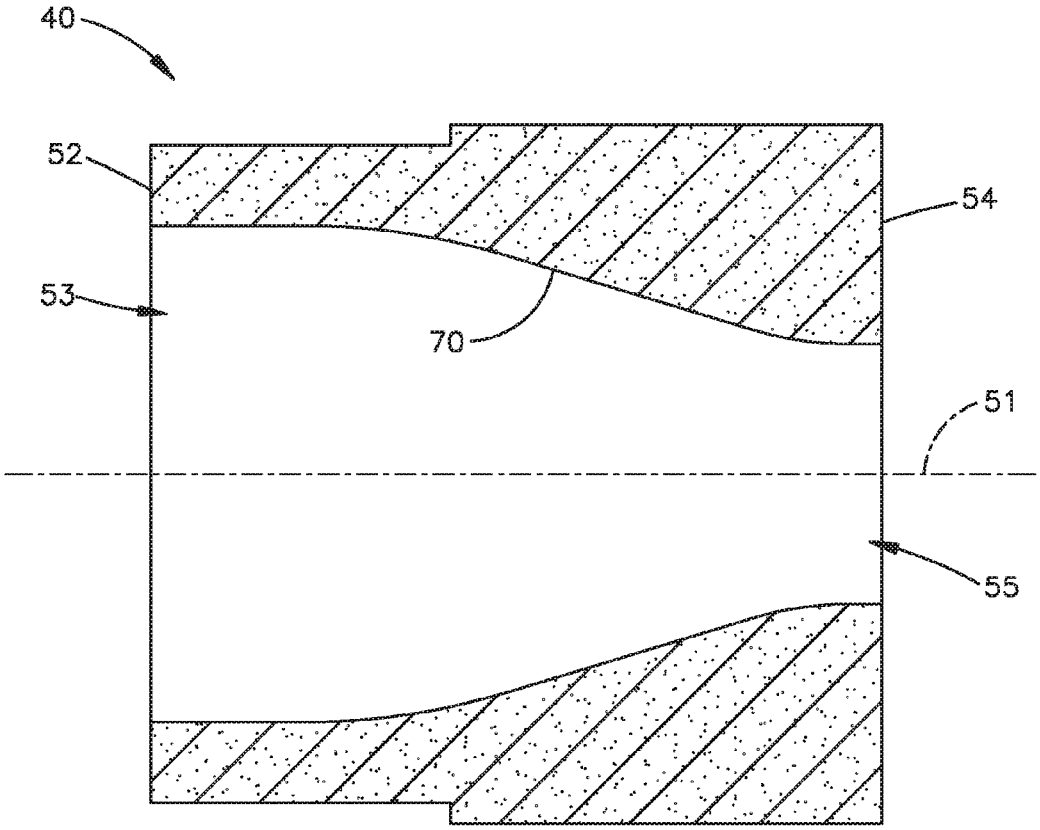
FIG. 2 is a separate view of a part shown in FIG. 1.

As shown in FIG. 2, the first tile structure 40 is cylindrical with a longitudinal central axis 51. An inner end surface 52 defines an open inner end 53 that is centered on the axis 51. An outer end surface 54 defines an outlet port 55 that also is centered on the axis 51, but the outlet port 55 is smaller than the open inner end 53. A cylindrical inner surface 70 reaches axially from the open inner end 53 to the outlet port 55, and has a non-linear profile that is tapered radially inward toward the outlet port 55.

Referring again to FIG. 1, the first tile structure 40 is received closely within a bore defined by a cylindrical inner surface 80 of the furnace wall 14. The outlet port 55 is centered on the axis 29, and the outer end surface 54 is preferably flush with the surrounding hot face surface 82 of the wall 14 beside the process chamber 12. The inner end surface 52 abuts the burner body 20 on a plate 88 at which the fuel plenum outlets 39 are located, and is spaced radially outward for the outlets 39 to provide gas flow communication from the fuel gas plenum 31 to the interior of the first tile structure 40.

Figure 3:
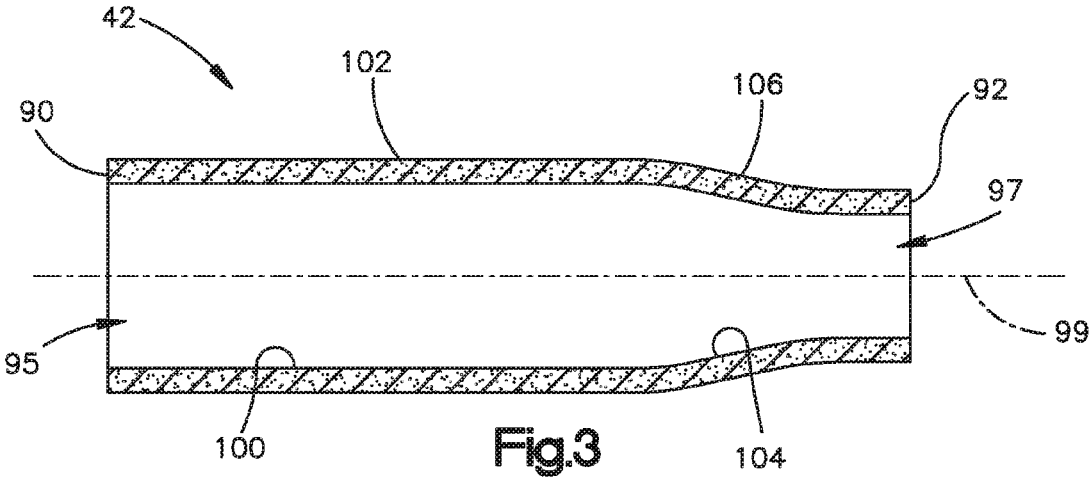
FIG. 3 is a separate view of another part shown in FIG. 1.

As shown separately in FIG. 3, the second tile structure 42 has a narrower cylindrical shape, with inner and outer end surfaces 90 and 92 defining inlet and outlet ports 95 and 97 on a longitudinal central axis 99. Cylindrical inner and outer surfaces 100 and 102 reach axially along the full length of the second tile structure 42, and have portions 104 and 106 with non-linear profiles that are tapered radially inward near the outlet port 97.

The second tile structure 42 is received closely through an opening 109 at the center of the plate 88 in the burner body 20. The outer surface 102 is closely fitted against a surrounding inner surface 112 of the body 20 inward of the plate 88. In this arrangement, the body 20 supports the second tile structure 42 in a position extending coaxially into the first tile structure 40. This provides an annular fuel flow passage 115 that reaches axially from the fuel plenum outlets 39 through the space defined radially between the two tile structures 40 and 42. The inlet port 95 at the second tile structure 42 is aligned with the combustion air inlet 27 so that a cylindrical air flow passage 117 reaches through the second tile structure 42 along the central axis 29 from the inlet port 95 to the outlet port 97.

As further shown schematically in FIG. 1, the burner 10 is connected in a reactant supply and control system including a fuel line 130 with a fuel valve 132 and an air line 136 with an air valve 138. The air line 136 reaches from a source of combustion air, such as a blower 140, to the air inlet 27 at the burner 10. The fuel line 130 reaches from a fuel source 142, such as a plant supply of natural gas, to the fuel inlet 33 at the burner 10. A controller 146 operates the fuel and air valves 132 and 138 to initiate, regulate, and terminate flows of fuel and combustion air to the burner 10. The controller 146 may comprise any suitable programmable logic controller or other control device, or combination of control devices, that is programmed or otherwise configured to perform as described in U.S. Patent Publication No. 2014/0272735, which is incorporated by reference, and to perform further as described and claimed herein.

Figure 4:
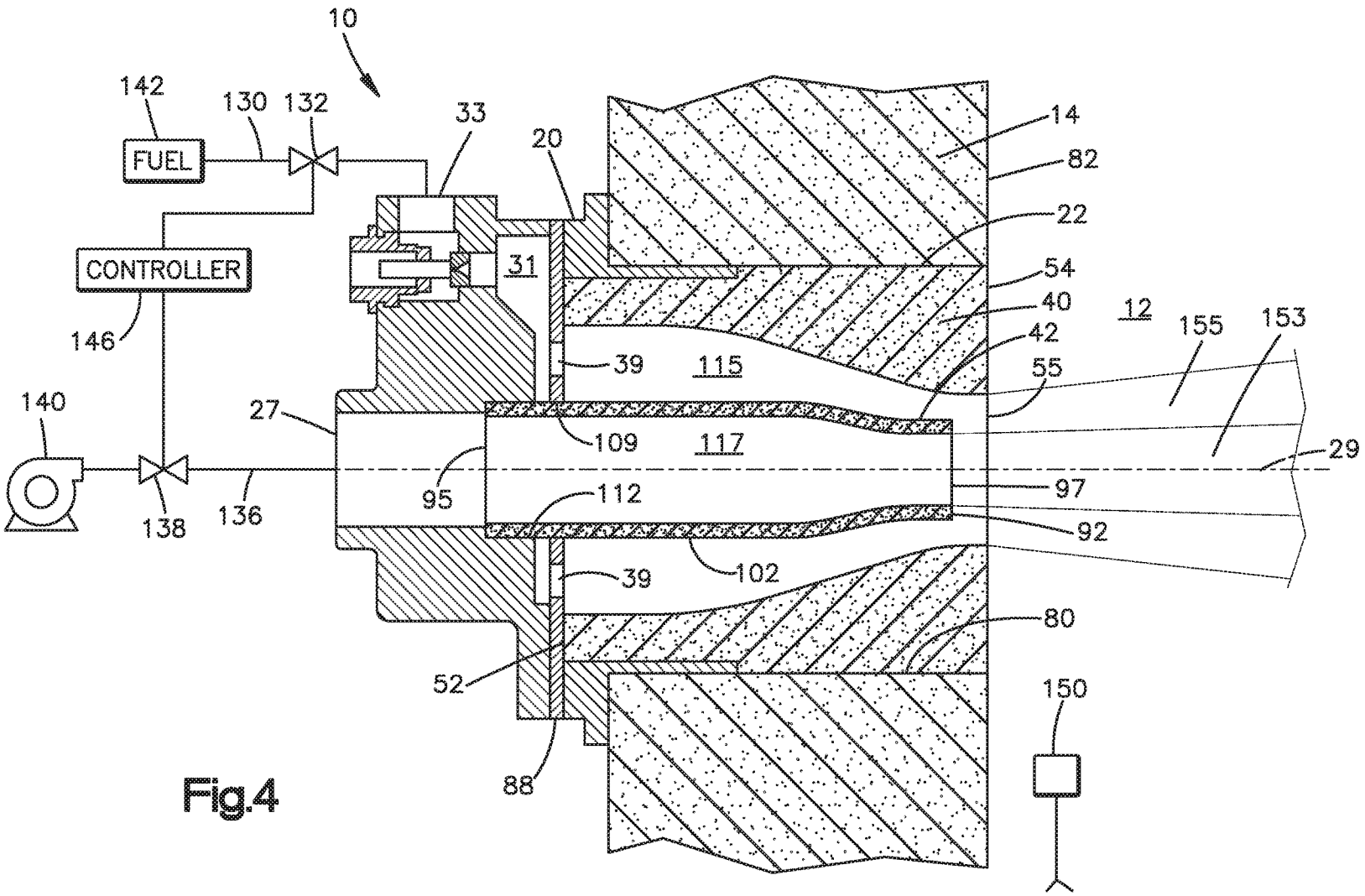
FIG. 4 is a schematic view showing the burner of FIG. 1 in operation.

The reactant supply and control system further includes a sensor 150 that senses a temperature inside the process chamber 12. In a preferred mode of operation, the controller 146 responds to the sensor 150 by initiating flows of fuel and combustion air to the burner 10 at a time when the sensed temperature is at or above an auto-ignition temperature of the fuel. Combustion air then flows into and through the combustion air inlet 27 and the air flow passage 117. The air continues to flow further along the axis 29 from the outlet port 97 at the second tile structure 42 to the outlet port 55 at the first tile structure 40, where it enters the process chamber 12. The fuel flows through the fuel gas plenum 311 to the outlets 39, into the interior of the first tile structure 40, and further along the annular fuel flow passage 115. This forms an annular stream of fuel that continues past the outer end 92 of the second tile structure 42 and onward to the outlet port 55 at the first tile structure 42, where it also enters the process chamber 12. As shown schematically in FIG. 4, the fuel and combustion air are thus directed into the process chamber 12 as unignited reactant streams concentric on the axis 37, with the air entering the process chamber 12 as a core stream 153 reaching along the axis 37, and the fuel entering the process chamber 12 separately as an annular peripheral stream 155 surrounding the core stream of air 153.

A diffuse mode of combustion results as the streams 153 and 155 form a combustible mixture that ignites at the elevated temperature in the process chamber 12. In its location at the periphery of the reactant streams injected from the burner 10, the fuel will more readily mix with the adjoining atmosphere of the process chamber 12, and will become more significantly diluted with POC's, before forming a combustible mixture with the air in the core stream 153. This suppresses the production of NOx.

Preferably, the velocities of the peripheral stream 155 and the core stream 153 are controlled to delay mixing by reducing the shear between those streams. This can be accomplished by injecting them into the process chamber at velocities that are equal or substantially equal to one another, or by modulating the velocities within a controlled range of difference from one another.

In accordance with a particular feature of the apparatus shown in FIG. 1, the outlet port 97 at the second tile structure 42 is spaced axially inward from the outlet port 55 at the first tile structure 40, which adjoins the process chamber 12. The outlet port 97 could have the same axial location as the outlet port 55, and could alternatively be spaced axially outward from the outlet port 55. In each case in which the outlet ports 97 and 55 are axially spaced apart, they are preferably spaced apart a distance that is not greater than the diameter of the outlet port 97 at the second tile structure 42.

Figure 5:
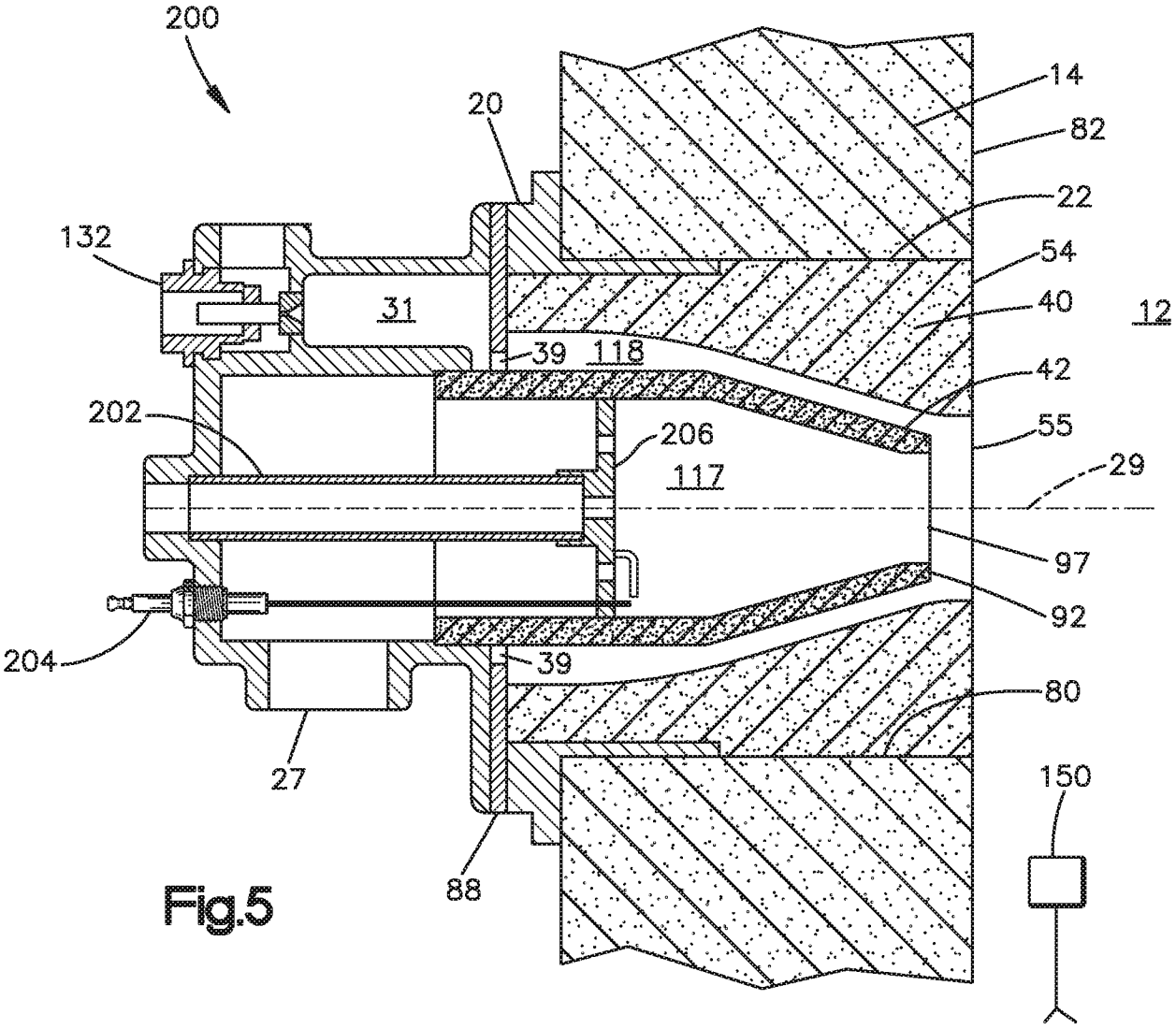
FIG. 5 is a schematic view similar to FIG. 1, showing an alternative burner.

Another embodiment of the apparatus is shown in FIG. 5. In this embodiment, the apparatus includes an alternative burner 200 in place of the burner 10 of FIG. 1. The alternative burner 200 has many parts that are the same or substantially the same as corresponding parts of the burner 10, as indicted by the use of the same reference numbers for such parts in FIGS. 1 and 5. The alternative burner 200 further has a core fuel injector 202, an igniter 204, and a flame stabilizer 206.

The alternative burner 200 can be operated in a start-up mode when the process chamber 12 has not yet reached the auto-ignition temperature required for DMC. In the start-up mode, all or most of the fuel supplied to the burner 200 is supplied to the core fuel injector 202. The core fuel injector 202 then injects a core stream of fuel into the air flow passage 117 along the central axis 29. The core fuel forms a combustible mixture with the core air flowing into the passage 117 from the combustion air inlet 27. The controller 146 actuates the igniter 204 to ignite the combustible mixture, which forms a stable flame in the passage 117 downstream of the flame stabilizer 206. When the process chamber 12 reaches the auto-ignition temperature, the core stream of fuel is terminated, and the annular peripheral stream 155 of fuel is initiated to provide DMC as described above regarding the burner 10.

Figure 6:
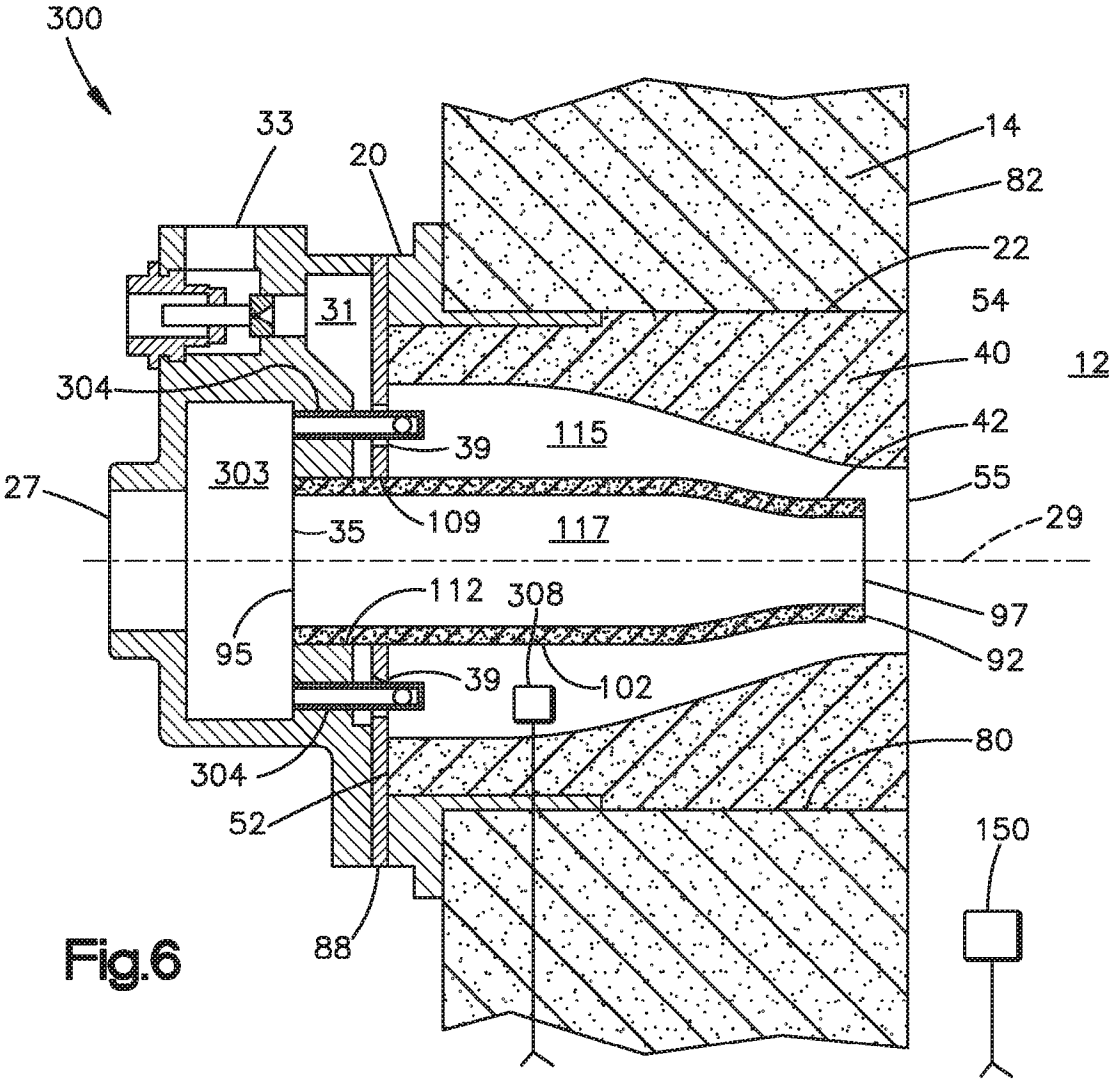
FIG. 6 also is a schematic view similar to FIG. 1, showing another alternative burner.

In yet another embodiment, the apparatus includes another alternative burner 300, as shown in FIG. 6. Like the alternative burner 200 of FIG. 5, the alternative burner 300 of FIG. 6 has many parts that are the same or substantially the same as corresponding parts of the burner 10. The alternative burner 300 further has a combustion air plenum 303 in air flow communication with the inlet 27, and has primary air injectors 304 providing air flow communication from the combustion air plenum 303 to the annular gas flow passage 115 in the tile portion 22 of the burner 200. In this context "primary" refers to the first air to mix with the fuel regardless of percentage. The combustion air flowing through the cylindrical air flow passage 117 would then be considered secondary air.

The alternative burner 300 also can be operated in a start-up mode when the process chamber 12 has not yet reached the auto-ignition temperature required for DMC. In the start-up mode, streams of primary air from the injectors 304 are mixed with the fuel in the annular gas flow passage 115 so that a peripheral reactant stream is provided as a combustible mixture of fuel and primary air. The controller 146 actuates an igniter 308, and the combustible mixture starts burning just downstream of the injectors 304 with a flame that fills the gas flow passage 115. The flame burns until it reaches into the process chamber 12 sufficiently to get enough oxygen to complete combustion. When the process chamber 12 reaches the auto-ignition temperature, the streams of primary air are terminated to provide DMC with the annular peripheral stream 155 of fuel and a core stream of air.

This written description sets for the best mode of carrying out the invention, and describes the invention so as to enable a person skilled in the art to make and use the invention, by presenting examples of the elements recited in the claims. The patentable scope of the invention is defined by the claims, and may include other examples that do not differ from the literal language of the claims, as well as equivalent examples with insubstantial differences from the literal language of the claims.

What is claimed is:

1. An apparatus for use with a fuel source and a source of combustion air, comprising:

a burner body structure defining a combustion air inlet communicating with the source of combustion air and a fuel gas inlet communicating with the fuel source;

a first burner nozzle structure configured to receive fuel gas from the fuel gas inlet, configured to receive combustion air from the combustion air inlet to form a combustible mixture of fuel gas and combustion air, and having a first outlet port centered on an axis;

a second burner nozzle structure configured to receive combustion air from the combustion air inlet, having a second outlet port centered on the axis of the first outlet port, and extending axially within the first burner nozzle structure to define an annular gas flow passage located within the first burner nozzle structure radially between the first and second burner nozzle structures;

an igniter located within the annular gas flow passage to ignite the combustible mixture of fuel gas and combustion air within the annular gas flow passage.

2. An apparatus as defined in claim 1 wherein the first outlet port has a diameter, and the first and second outlet ports are axially spaced apart a distance not greater than the diameter of the first outlet port.

3. An apparatus as defined in claim 1 wherein the second outlet port is spaced axially inward from the first outlet port.

4. An apparatus as defined in claim 1 wherein the second outlet port is spaced axially outward from the first outlet port.

5. An apparatus as defined in claim 1 wherein the second outlet port is not spaced axially from the first outlet port.

6. An apparatus as defined in claim 1 wherein the first burner nozzle structure is tapered radially inward toward the first outlet port.

7. An apparatus as defined in claim 1 wherein the second burner nozzle structure is tapered radially inward toward the second outlet port.

8. An apparatus as defined in claim 1 wherein each of the first and second burner nozzle structures is a unitary body of refractory material separate from the other.

9. An apparatus for use with a fuel source and a source of combustion air, comprising:

a burner body structure defining a combustion air inlet and a fuel gas inlet;

a first burner nozzle structure configured to receive fuel gas from the fuel gas inlet and having a first outlet port centered on an axis;

a second burner nozzle structure configured to receive combustion air from the combustion air inlet, having a central gas flow passage with a second outlet port centered on the axis of the first outlet port, and extending axially within the first nozzle structure to define an annular gas flow passage located within the first burner nozzle structure radially between the first and second burner nozzle structures; and a reactant supply and control system including an air line reaching from the source of combustion air to the combustion air inlet, an air valve in the air line, a fuel line reaching from the fuel source to the fuel gas inlet, and a fuel valve in the fuel line;

wherein the reactant supply and control system further includes a controller configured to operate the air valve and the fuel valve to cause combustion air in the central gas flow passage to exit the second outlet port at a first velocity, and to cause fuel gas in the annular gas flow passage to exit the first outlet port at a second velocity that is equal or substantially equal to the first velocity.

* * * * *